US010168639B2

(12) United States Patent
Yokoi

(10) Patent No.: US 10,168,639 B2
(45) Date of Patent: Jan. 1, 2019

(54) DEVELOPING CARTRIDGE INCLUDING HOLDER COVER THAT COVERS HOLDER HOLDING ELECTRICAL CONTACT SURFACE

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/710,355

(22) Filed: Sep. 20, 2017

(65) Prior Publication Data

US 2018/0284647 A1 Oct. 4, 2018

(30) Foreign Application Priority Data

Mar. 31, 2017 (JP) ..... 2017-070354

(51) Int. Cl.
*G03G 15/08* (2006.01)

(52) U.S. Cl.
CPC ..... *G03G 15/0863* (2013.01); *G03G 15/0808* (2013.01); *G03G 15/0865* (2013.01); *G03G 2221/1823* (2013.01); *G03G 2221/1869* (2013.01)

(58) Field of Classification Search
CPC ..... G03G 15/0863; G03G 2221/1823
See application file for complete search history.

(56) References Cited

U.S. PATENT DOCUMENTS

2008/0199204 A1* 8/2008 Ishii ..... G03G 15/55 399/90
2013/0051849 A1 2/2013 Itabashi et al.
2013/0266340 A1* 10/2013 Hashimoto ..... G03G 21/1676 399/119
2014/0099143 A1* 4/2014 Oda ..... G03G 21/1821 399/110
2015/0037059 A1* 2/2015 Yang ..... G03G 15/0863 399/90
2017/0184998 A1* 6/2017 Itabashi ..... G03G 15/0865
2017/0185032 A1* 6/2017 Itabashi ..... G03G 15/0875
2018/0046131 A1* 2/2018 Itabashi ..... G03G 21/1867
2018/0196373 A1* 7/2018 Itabashi ..... G03G 15/0865

FOREIGN PATENT DOCUMENTS

JP 2013-054058 A 3/2013

* cited by examiner

*Primary Examiner* — Sevan A Aydin
(74) *Attorney, Agent, or Firm* — Merchant & Gould P.C.

(57) ABSTRACT

A developing cartridge includes: a casing, a developing roller, a storage medium having an electrical contact surface, a holder, and a holder cover configured to cover the holder. The holder has: a first outer surface holding the electrical contact surface, a second outer surface spaced away from the first outer surface in a third direction, and a resilient member connected to the first outer surface and to the second outer surface. The resilient member is configured to expand and contract to change a distance between the first outer surface and the second outer surface. The resilient member has a first length in the third direction in a state where the holder cover is detached from the holder. The resilient member has a second length in the third direction smaller than the first length in a state where the holder cover is attached to the holder.

7 Claims, 13 Drawing Sheets

DEVELOPING CARTRIDGE INCLUDING HOLDER COVER THAT COVERS HOLDER HOLDING ELECTRICAL CONTACT SURFACE

CROSS REFERENCE TO RELATED APPLICATION

This application claims priority from Japanese Patent Application No. 2017-070354 filed Mar. 31, 2017. The entire content of the priority application is incorporated herein by reference.

TECHNICAL FIELD

The present disclosure relates to a developing cartridge, a process cartridge, and an image forming apparatus.

BACKGROUND

There is conventionally known an electro-photographic type image forming apparatus such as a laser printer and an LED printer. A developing cartridge is used for the image forming apparatus. The developing cartridge includes a developing roller for supplying toner.

The developing cartridge in a prior art is configured to be attached to a drum cartridge. The drum cartridge includes a photosensitive drum. In a state where the developing cartridge is attached to the drum cartridge, the photosensitive drum and the developing roller of the developing cartridge are in contact with each other. Then, the drum cartridge to which the developing cartridge is attached to the image forming apparatus in a state where the developing cartridge is attached to the drum cartridge.

SUMMARY

Further, a developing cartridge including a storage medium is known in the prior art. An IC chip is an example of the storage medium. The storage medium has an electrical contact surface configured to be in contact with an electrical contact of the image forming apparatus. A controller of the image forming apparatus obtains necessary information from the storage medium. In such the conventional developing cartridge, protection of the electrical contact surface is required in a state before the developing cartridge is attached to the image forming apparatus. Alternatively, protection of the electrical contact surface is required also in a case where the image forming apparatus is shipped in a state where the developing cartridge is attached to the image forming apparatus.

In view of the foregoing, it is an object of the disclosure to provide a developing cartridge, a process cartridge, and an image forming apparatus capable of protecting an electrical contact surface.

In order to attain the above and other objects, according to one aspect, the disclosure provides a developing cartridge including: a casing, a developing roller, a storage medium, a holder, and a holder cover. The casing is configured to accommodate toner therein. The developing roller is rotatable about a first axis extending in a first direction. The developing roller is positioned at one end portion of the casing in a second direction. The storage medium has an electrical contact surface. The holder is positioned at one end of the casing in the first direction. The holder holds the electrical contact surface. The holder has: a first outer surface, a second outer surface, and a resilient member. The first outer surface is positioned at one end portion of the holder in a third direction crossing the electrical contact surface. The first outer surface holds the electrical contact surface. The second outer surface is positioned at another end portion of the holder in the third direction. The second outer surface is spaced away from the first outer surface in the third direction. The resilient member is positioned between the first outer surface and the second outer surface. The resilient member is configured to expand and contract in the third direction. The resilient member is connected to the first outer surface and to the second outer surface. A distance between the first outer surface and the second outer surface in the third direction is configured to change by the expansion and contraction of the resilient member. The holder cover is configured to be attached to the holder to cover at least a portion of the holder. The holder cover is configured to urge the first outer surface toward the second outer surface and to urge the second outer surface toward the first outer surface in a state where the holder cover is attached to the holder. The resilient member has a first length in the third direction in a state where the holder cover is detached from the holder. The resilient member has a second length in the third direction smaller than the first length in a state where the holder cover is attached to the holder.

According to another aspect, the disclosure provides a process cartridge including: a developing cartridge, and a drum cartridge to which the developing cartridge is attachable. The developing cartridge includes: a casing, a developing roller, a storage medium, a holder, and a holder cover. The casing is configured to accommodate toner therein. The developing roller is rotatable about a first axis extending in a first direction. The developing roller is positioned at one end portion of the casing in a second direction. The storage medium has an electrical contact surface. The holder is positioned at one end of the casing in the first direction. The holder holds the electrical contact surface. The holder has: a first outer surface, a second outer surface, and a resilient member. The first outer surface is positioned at one end portion of the holder in a third direction crossing the electrical contact surface. The first outer surface holds the electrical contact surface. The second outer surface is positioned at another end portion of the holder in the third direction. The second outer surface is spaced away from the first outer surface in the third direction. The resilient member is positioned between the first outer surface and the second outer surface. The resilient member is configured to expand and contract in the third direction. The resilient member is connected to the first outer surface and to the second outer surface. A distance between the first outer surface and the second outer surface in the third direction is configured to change by the expansion and contraction of the resilient member. The holder cover is configured to be attached to the holder to cover at least a portion of the holder. The holder cover is configured to urge the first outer surface toward the second outer surface and to urge the second outer surface toward the first outer surface in a state where the holder cover is attached to the holder. The resilient member has a first length in the third direction in a state where the holder cover is detached from the holder. The resilient member has a second length in the third direction smaller than the first length in a state where the holder cover is attached to the holder. The drum cartridge includes: a photosensitive drum, and a drum coupling. The photosensitive drum is rotatable about a second axis extending in the first direction. The drum coupling is positioned at one end portion of the photosensitive drum in the first direction. The holder cover is configured to cover the drum coupling of the drum cartridge in a state where the holder cover is attached to the holder of the developing cartridge that has been attached to the drum cartridge.

According to still another aspect, the disclosure provides an image forming apparatus including: a developing cartridge, a cartridge holding portion to which the developing cartridge is attachable, and an electrical contact. The developing cartridge includes: a casing, a developing roller, a storage medium, a holder, and a holder cover. The casing is configured to accommodate toner therein. The developing roller is rotatable about a first axis extending in a first direction. The developing roller is positioned at one end portion of the casing in a second direction. The storage medium has an electrical contact surface. The holder is positioned at one end of the casing in the first direction. The holder holds the electrical contact surface. The holder has: a first outer surface, a second outer surface, and a resilient member. The first outer surface is positioned at one end portion of the holder in a third direction crossing the electrical contact surface. The first outer surface holds the electrical contact surface. The second outer surface is positioned at another end portion of the holder in the third direction. The second outer surface is spaced away from the first outer surface in the third direction. The resilient member is positioned between the first outer surface and the second outer surface. The resilient member is configured to expand and contract in the third direction. The resilient member is connected to the first outer surface and to the second outer surface. A distance between the first outer surface and the second outer surface in the third direction is configured to change by the expansion and contraction of the resilient member. The holder cover is configured to be attached to the holder to cover at least a portion of the holder. The holder cover is configured to urge the first outer surface toward the second outer surface and to urge the second outer surface toward the first outer surface in a state where the holder cover is attached to the holder. The resilient member has a first length in the third direction in a state where the holder cover is detached from the holder. The resilient member has a second length in the third direction smaller than the first length in a state where the holder cover is attached to the holder. The electrical contact is configured to be in contact with the electrical contact surface in a state where the developing cartridge in which the holder cover is not attached to the holder is attached to the cartridge holding portion. The electrical contact is configured to be spaced away from the electrical contact surface in the third direction in a state where the developing cartridge in which the holder cover is attached to the holder is attached to the cartridge holding portion.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an image forming apparatus 100 according to one embodiment of the present disclosure will be described with reference to FIG. 1.

[1. Structure of Image Forming Apparatus]

Figure 1:
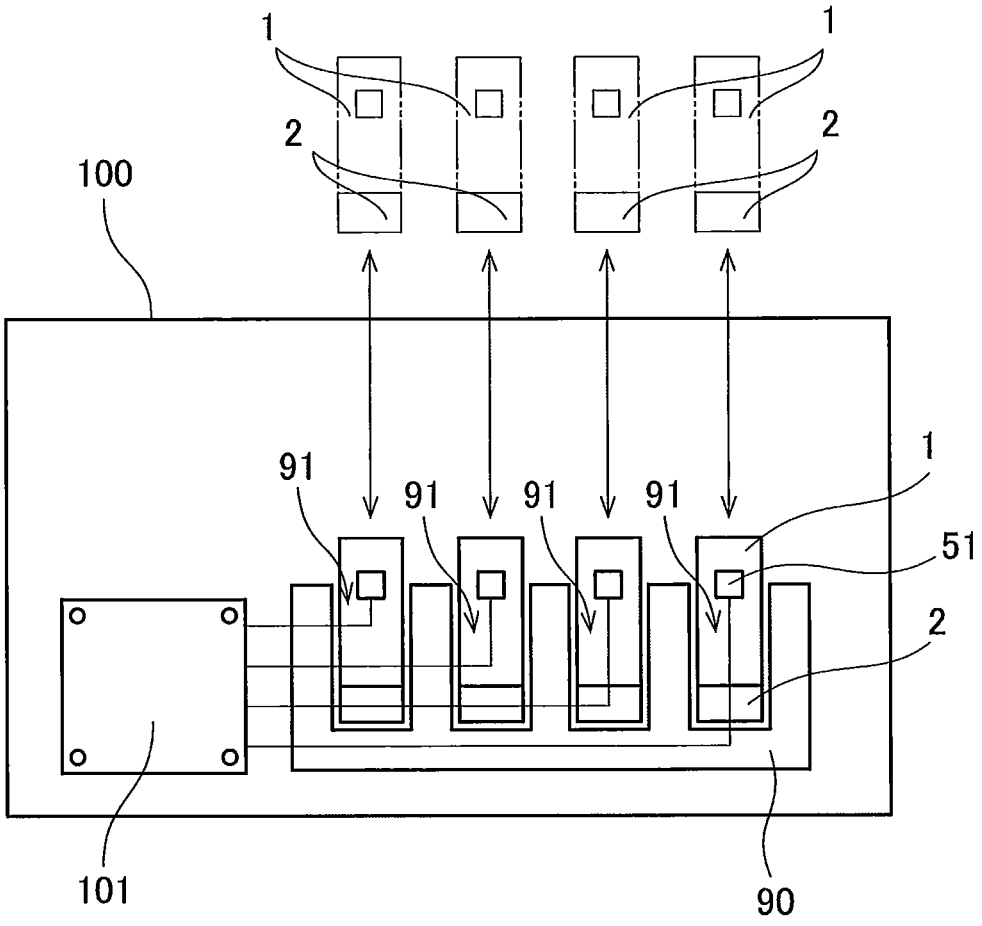
FIG. 1 is a conceptual diagram of an image forming apparatus according to one embodiment of the present disclosure.

FIG. 1 is a conceptual diagram of the image forming apparatus 100. The image forming apparatus 100 is an electro-photographic type printer, such as a laser printer and an LED printer.

The image forming apparatus 100 includes four developing cartridges 1, four drum cartridges 2, and a cartridge holding portion 90.

The developing cartridges 1 are configured to be attached to the drum cartridges 2. The developing cartridges 1, which are attached to the drum cartridges 2, are attached to the cartridge holding portion 90. The four developing cartridges 1 respectively accommodate toner of different colors (for example, cyan, magenta, yellow, and black). However, the number of the developing cartridge 1 may be any one of one through three, or more than five.

The cartridge holding portion 90 is a frame to which the developing cartridges 1 attached to the drum cartridges 2 are attached. The cartridge holding portion 90 includes four slots 91. The developing cartridges 1 attached to the corresponding drum cartridges 2 are configured to be attached to the respective slots 91. The image forming apparatus 100 is configured to form an image on a recording surface of a printing sheet using toner supplied from the four developing cartridges 1.

Each of the four developing cartridges 1 includes an IC chip 51 (an example of a storage medium). The IC chip 51 is a storage medium from which information is readable and to which information is writable. Further, the image forming apparatus 100 includes a controller 101. When the developing cartridges 1 attached to the drum cartridges 2 are attached to the respective slots 91, the IC chip 51 of each developing cartridge 1 is electrically connected to the controller 101. The controller 101 is configured of, for example, a circuit board. The controller 101 includes a processor such as CPU, and various memories. The controller 101 is configured to execute various types of processing in the image forming apparatus 100 by operating the processor in accordance with programs.

[2.1 Developing Cartridge]

Figure 2:
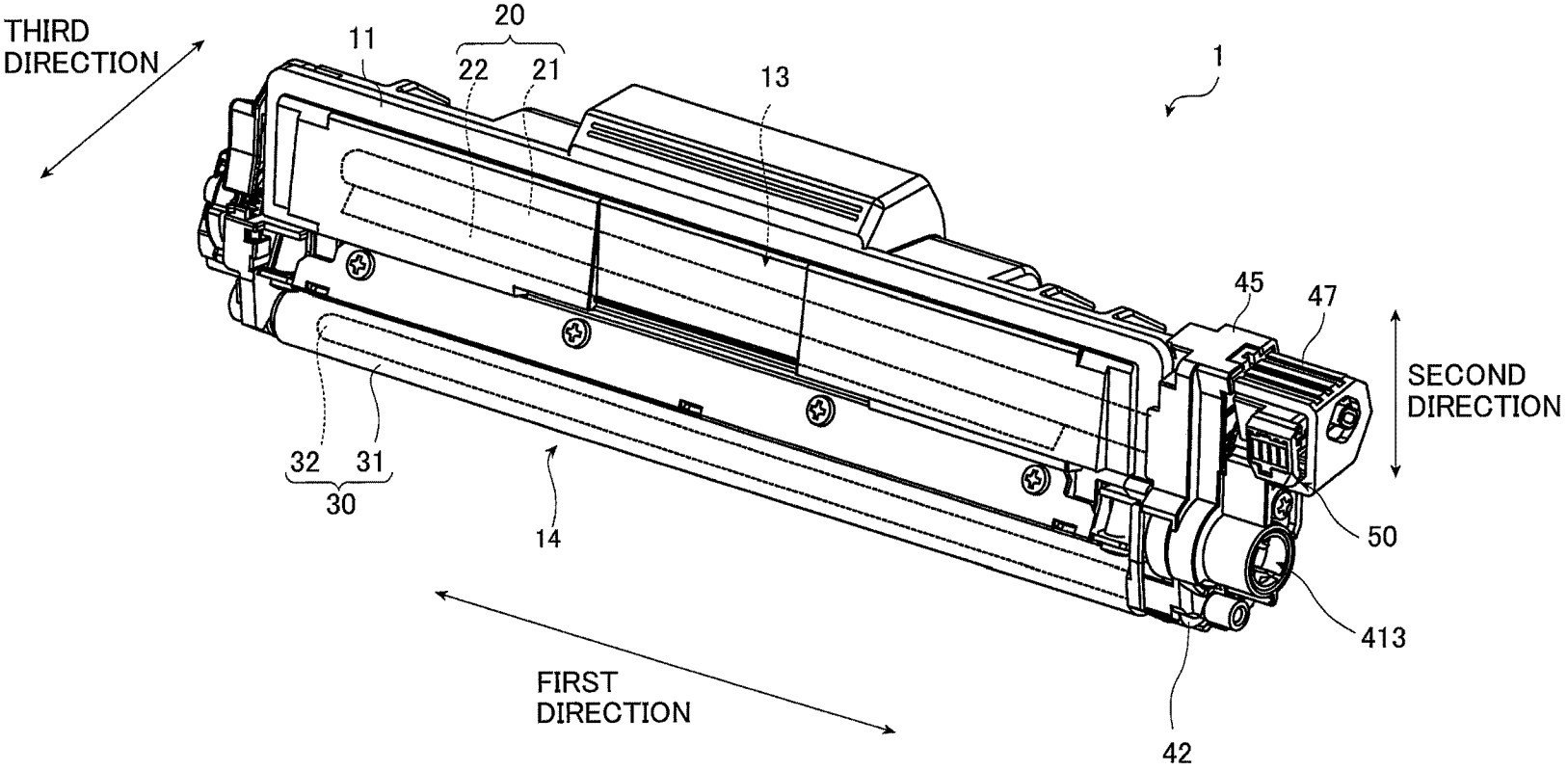
FIG. 2 is a perspective view of a developing cartridge according to the embodiment.
Figure 3:
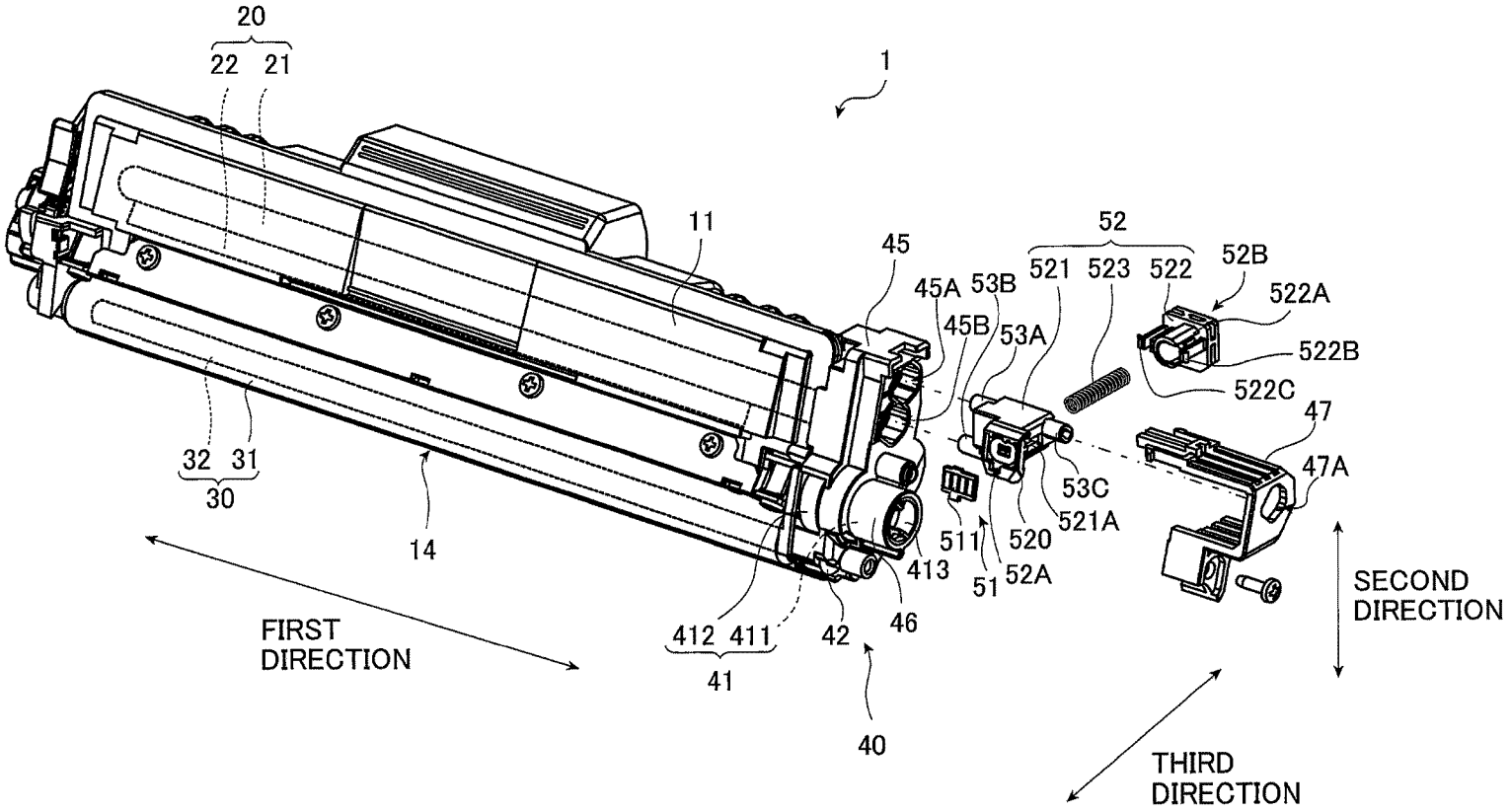
FIG. 3 is an exploded perspective view of the developing cartridge according to the embodiment.

FIG. 2 is a perspective view of the developing cartridge 1, and FIG. 3 is an exploded perspective view of the developing cartridge 1.

Each of the developing cartridges 1 includes a casing 11, an agitator 20, a developing roller 30, a gear portion 40, and an IC chip assembly 50.

The casing 11 extends in one direction, and accommodates toner therein. In the following description, a direction in which the casing 11 extends will be referred to as a first direction. The first direction is coincident with a direction in which a rotational axis of the developing roller 30 extends. Further, a direction in which the developing roller 30 and the agitator 20 are aligned will be referred to as a second direction. The developing roller 30 is positioned at one end portion of the casing 11 in the second direction. The first direction and the second direction cross each other, preferably, are perpendicular to each other. Still further, a direction crossing an electrical contact surface 511 (described later) of the IC chip 51 will be referred to as a third direction. The third direction crosses the first direction and the second direction, preferably, is perpendicular to the first direction and the second direction.

An accommodation chamber 13 is positioned in an interior of the casing 11. The accommodation chamber 13 is configured to accommodate toner therein. The casing 11 has an opening 14 positioned at the one end portion of the casing 11 in the second direction. When the developing cartridge 1 is attached to the corresponding drum cartridge 2, the opening 14 faces the drum cartridge 2. The accommodation chamber 13 is in communication with an outside through the opening 14.

The agitator 20 includes an agitator shaft 21 and an agitation blade 22. The agitator shaft 21 extends in the first direction. The agitation blade 22 extends radially outward from the agitator shaft 21. At least a portion of the agitator shaft 21 and the agitation blade 22 are positioned inside the accommodation chamber 13. The agitator shaft 21 has one end portion in the first direction to which an agitator gear (not illustrated and described later) is mounted. The agitator shaft 21 and the agitation blade 22 are rotatable along with rotation of the agitator gear. When the agitation blade 22 rotates, toner in the accommodation chamber 13 is agitated.

The developing roller 30 is positioned at the one end portion of the casing 11 in the second direction. Incidentally, the second direction is coincident with an insertion direction of the developing cartridges 1 attached to the drum cartridges 2 into the corresponding slots 91 of the image forming apparatus 100. The developing roller 30 is rotatable about the rotational axis (an example of a first axis) extending in the first direction. The developing roller 30 is positioned at the opening 14 of the casing 11.

The developing roller 30 includes a developing roller body 31 and a developing roller shaft 32. The developing roller body 31 is hollow cylindrical member extending in the first direction. The developing roller body 31 is made of rubber having elasticity, for example. The developing roller shaft 32 is a solid cylindrical member extending through the developing roller body 31 in the first direction. The developing roller shaft 32 is made of metal or electrically conductive resin. The developing roller body 31 is fixed to the developing roller shaft 32 so as not to rotate relative to the developing roller shaft 32.

The developing roller shaft 32 has one end portion in the first direction to which a developing roller gear 42 is mounted. The one end portion of the developing roller shaft 32 in the first direction is fixed to the developing roller gear 42 illustrated in FIG. 3 so as not to rotate relative to the developing roller gear 42. The developing roller shaft 32 rotates upon rotation of the developing roller gear 42, whereby the developing roller body 31 also rotates together with the developing roller shaft 32.

Incidentally, the developing roller shaft 32 may not necessarily extend through the developing roller body 31 in the first direction. For example, a developing roller shaft 32 may extend in the first direction from each end of the developing roller body 31 in the first direction.

The developing cartridge 1 further includes a supply roller (not illustrated). The supply roller is positioned in the accommodation chamber 13 at a position between the developing roller 30 and the agitator 20. The supply roller is rotatable about a rotational axis extending in the first direction. When a driving force is applied to the developing cartridge 1, toner is supplied from the accommodation chamber 13 of the casing 11 to an outer circumferential surface of the developing roller 30 (i.e., outer circumferential surface of the developing roller body 31) through the supply roller. At this time, toner is triboelectic charged at a position between the supply roller and the developing roller 30. On the other hand, bias voltage is applied to the developing roller shaft 32 of the developing roller 30. Therefore, toner is attracted to the outer circumferential surface of the developing roller body 31 because of an electrostatic force generated between the developing roller shaft 32 and toner.

The developing cartridge 1 further includes a layer thickness regulation blade (not illustrated). The layer thickness regulation blade is configured to regulate a thickness of a layer of toner supplied to the outer circumferential surface of the developing roller body 31 so that the thickness of the layer of toner is formed to a constant thickness. Then, toner on the outer circumferential surface of the developing roller body 31 is supplied to a photosensitive drum 71 (described later) of the drum cartridge 2. At this time, toner is moved from the developing roller body 31 to the photosensitive drum 71 in accordance with an electrostatic latent image formed on an outer circumferential surface of the photosensitive drum 71. Hence, the electrostatic latent image on the outer circumferential surface of the photosensitive drum 71 becomes a visible image.

The gear portion 40 is positioned at an outer surface of one end of the casing 11 in the first direction. As illustrated in FIG. 3, the gear portion 40 includes a coupling 41 (an example of a developing coupling), the developing roller gear 42, an idle gear (not illustrated), the agitator gear (not illustrated), and an inner cover 45. Incidentally, a plurality of gear teeth of each gear is omitted in FIG. 3.

The coupling 41 is a developing coupling configured to first receive a driving force supplied from the image forming apparatus 100. The coupling 41 is rotatable about a rotational axis extending in the first direction. The coupling 41 includes a coupling portion 411, and a coupling gear 412. The coupling portion 411 has a coupling hole 413 recessed in the first direction. The inner cover 45 includes a collar 46 into which the coupling portion 411 is fitted. A plurality of gear teeth are positioned at an equal interval over an entire outer circumferential surface of the coupling gear 412.

When the developing cartridge 1 attached to the drum cartridge 2 is attached to the cartridge holding portion 90, a drive shaft of the image forming apparatus 100 is inserted into the coupling hole 413. Accordingly, the drive shaft and the coupling portion 411 are coupled to each other so that relative rotation between the drive shaft and the coupling portion 411 is prevented. In accordance with rotation of the drive shaft, the coupling portion 411 rotates, thereby causing the coupling gear 412 to rotate together with the coupling portion 411.

The developing roller gear 42 is configured to rotate the developing roller 30. The developing roller gear 42 is rotatable about the rotational axis extending in the first direction. A plurality of gear teeth are positioned at an equal interval over an entire outer circumferential surface of the developing roller gear 42. Some of the plurality of gear teeth of the coupling gear 412 are in meshing engagement with some of the plurality of gear teeth of the developing roller gear 42. Further, the developing roller gear 42 is fixed to the one end portion in the first direction of the developing roller shaft 32 so as not to rotate relative to the developing roller shaft 32. Accordingly, the developing roller gear 42 rotates upon rotation of the coupling gear 412, whereby the developing roller 30 rotates together with the developing roller gear 42.

The idle gear is configured to transmit rotation of the coupling gear 412 to the agitator gear. The agitator gear is configured to rotate the agitator 20. The agitator gear is rotatable about a rotational axis extending in the first direction. A plurality of gear teeth is positioned at an equal interval over an entire outer circumferential surface of the agitator gear. The agitator gear is fixed to one end portion in the first direction of the agitator shaft 21 so that relative rotation between the agitator shaft 21 and the agitator gear is prevented. Hence, when a driving force is transmitted from the coupling 41 to the agitator gear through the idle gear, the agitator gear is rotated, thereby causing the agitator 20 to be rotated together with the agitator gear.

The inner cover 45 is fixed to the outer surface of the one end in the first direction of the casing 11, for example, by means of screws. The inner cover 45 is configured to accommodate therein the coupling gear 412, the developing roller gear 42, the idle gear, and the agitator gear. The inner cover 45 includes the collar 46 extending in the first direction. The collar 46 has a hollow cylindrical shape. The coupling portion 411 is fitted into the collar 46. The developing cartridge 1 further includes an outer cover 47 fixed to the inner cover 45. The outer cover 47 is positioned opposite to the casing 11 with respect to the inner cover 45 in the first direction.

[2.2 IC Chip Assembly]

As illustrated in FIG. 3, the IC chip assembly 50 includes the IC chip 51 as the storage medium, and a holder 52 holding the IC chip 51. The IC chip 51 includes the four electrical contact surfaces 511. Each electrical contact surface 511 is made of electrically conductive metal. The IC chip 51 is configured to store various information relating to the developing cartridge 1. Incidentally, the numbers of the electrical contact surface 511 may be one through three, or more than five.

The holder 52 has a first outer surface 52A and a second outer surface 52B. The first outer surface 52A is positioned at one end portion of the holder 52 in the third direction, and the second outer surface 52B is positioned at another end portion of the holder 52 in the third direction. The first outer surface 52A is movable in the third direction relative to the second outer surface 52B.

More specifically, the holder 52 includes a first holder member 521, a second holder member 522, and a coil spring 523 (an example of a resilient member) interposed therebetween. The first holder member 521 and the second holder member 522 are made of resin, for example. The first holder member 521 has the first outer surface 52A. The first outer surface 52A contains a holding surface 520 to which the IC chip 51 is fixed. The second holder member 522 has the second outer surface 52B. In an assembled state of the holder 52, the first outer surface 52A and the second outer surface 52B are spaced away from each other in the third direction.

The coil spring 523 is a resilient member configured to expand and contract in the third direction. The coil spring 523 is positioned between the first outer surface 52A and the second outer surface 52B in the third direction. The coil spring 523 can be directly connected to both the first outer surface 52A and the second outer surface 52B, or may be indirectly connected thereto through connection members. At least, the coil spring 523 is configured to expand and contract in the third direction between a first state and a second state. The coil spring 523 in the second state is more compressed than the coil spring 523 in the first state. The coil spring 523 in the first state has a length in the third direction (an example of a first length) greater than a length in the third direction of the coil spring 523 in the second state (an example of a second length). Therefore, a distance between the first outer surface 52A and the second outer surface 529 in the third direction in the first state of the coil spring 523 is greater than the distance between the first outer surface 52A and the second outer surface 52B in the third direction in the second state of the coil spring 523. Further, at least, the length of the coil spring 523 in the second state is smaller than a natural length of the coil spring 523.

The second holder member 522 includes a spring holder 522A. A spring holder 522A has a hollow cylindrical shape. More specifically, the spring holder 522A protrudes from the second holder member 522 in the third direction. The coil spring 523 is inserted into the spring holder 522A. Incidentally, a cylindrical protrusion (see FIG. 5) is positioned in an internal space of the spring holder 522A. The protrusion is inserted into an inner side of the coil spring 523. With this configuration, the coil spring 523 is supported by an outer circumferential surface of the protrusion and an inner circumferential surface of the spring holder 522A.

A first pawl portion 522B and a second pawl portion 522C are positioned in the second holder member 522. Each of the first pawl portion 522B and the second pawl portion 522C protrudes from the second holder member 522 in a direction crossing the third direction. The first holder member 521 has a first opening 521A. The first pawl portion 522B is inserted into the first opening 521A. Further, the first holder member 521 also has a second opening (not illustrated). The second opening is positioned on the opposite side of the first opening 521A in the first direction. The second pawl portion 522C is inserted into the second opening.

In the first state of the coil spring 523, the first pawl portion 522B is in contact with the first holder member 521 at an edge of the first opening 521A closer to the second outer surface 529 than an opposite edge is to the second outer surface 529 in the third direction. Further, in the first state of the coil spring 523, the second pawl portion 522C is in contact with the first holder member 521 at an edge of the second opening closer to the second outer surface 52B than an opposite edge is to the second outer surface 52B in the third direction. Thus, the length of the coil spring 523 in the third direction can be prevented from expanding rather than the length of the coil spring 523 in the first state. Further, detachment of the first holder member 521 from the second holder member 522 can be prevented. On the other hand, in the second state of the coil spring 523, the first pawl portion 522B and the second pawl portion 522C are separated from the first holder member 521.

The IC chip 51 is fixed to the holding surface 520 contained in the first outer surface 52A of the first holder member 521. In other words, the first outer surface 52A holds the electrical contact surface 511 of the IC chip 51. That is, the electrical contact surface 511 of the IC chip 51 moves in the third direction in accordance with movement of the first holder member 521 in the third direction relative to the second holder member 522. Incidentally, the IC chip 51 is fixed to a position recessed in the third direction from the first outer surface 52A toward the second holder member 522.

Bosses 53A, 53B, and 53C are positioned in the first holder member 521. More specifically, the bosses 53A, 53B, and 53C are positioned at outer surfaces of the first holder member 521 crossing the first direction. The bosses 53A and 53B are positioned at an outer surface of the first holder member 521 facing the inner cover 45. The bosses 53A and 53B protrude in the first direction toward the inner cover 45 from the outer surface of the first holder member 521. On the other hand, the inner cover 45 has a through-hole 45A and a through-hole 45B. The through-hole 45A and the through-hole 45B extend through the inner cover 45 in the first direction. The boss 53A is inserted into the through-hole 45A, and the boss 53B is inserted into the through-hole 45B. Incidentally, the through-hole 45A may be a recessed portion configured to receive the boss 53A, and the through-hole 459 may be a recessed portion configured to receive the boss 53B.

The boss 53C is positioned at an outer surface of the first holder member 521 facing the outer cover 47. The boss 53C protrudes in the first direction toward the outer cover 47 from the outer surface of the first holder member 521. On the other hand, the outer cover 47 has a through-hole 47A extending through the outer cover 47 in the first direction. The boss 53C is inserted into the through-hole 47A. Incidentally, the through-hole 47A may be a recessed portion configured to receive the boss 53C.

The through-hole 47A has a dimension (inner dimension) in the second direction greater than a dimension (outer dimension) in the second direction of the boss 53C. The through-hole 45A has a dimension (inner dimension) in the second direction greater than a dimension (outer dimension) in the second direction of the boss 53A. The through-hole 45B has a dimension (inner dimension) in the second direction greater than a dimension (outer dimension) in the second direction of the boss 53B. With this configuration, the holder 52 is movable together with the bosses 53A, 539, and 53C in the second direction relative to the inner cover 45 and the outer cover 47. Thus, the IC chip 51 having the electrical contact surface 511 is moved in the second direction along with the holder 52 in accordance with movement of the holder 52 in the second direction.

The through-hole 47A has a dimension (inner dimension) in the third direction greater than a dimension (outer dimension) in the third direction of the boss 53C. The through-hole 45A has a dimension (inner dimension) in the third direction greater than a dimension (outer dimension) in the third direction of the boss 53A. The through-hole 45B has a dimension (inner dimension) in the third direction greater than a dimension (outer dimension) in the third direction of the boss 53B. Accordingly, the holder 52 is movable together with the bosses 53A, 53B, and 53C in the third direction relative to the inner cover 45 and the outer cover 47. Thus, the IC chip 51 having the electrical contact surface 511 is moved in the third direction along with the holder 52 in accordance with movement of the holder 52 in the third direction.

Incidentally, the bosses 53A and 53B may be positioned at the inner cover 45, and the first holder member 521 may have the through-holes 45A and 45B. Further, the boss 53C may be positioned at the outer cover 47, and the first holder member 521 may have the through-hole 47A.

The developing cartridges 1 attached to the corresponding drum cartridges 2 are attached in the cartridge holding portion 90. In the following description, a unit of the drum cartridge 2 and the developing cartridge 1 attached to the drum cartridge 2 will be referred to a process cartridge 10.

[3.1 Process Cartridge]

Figure 4:
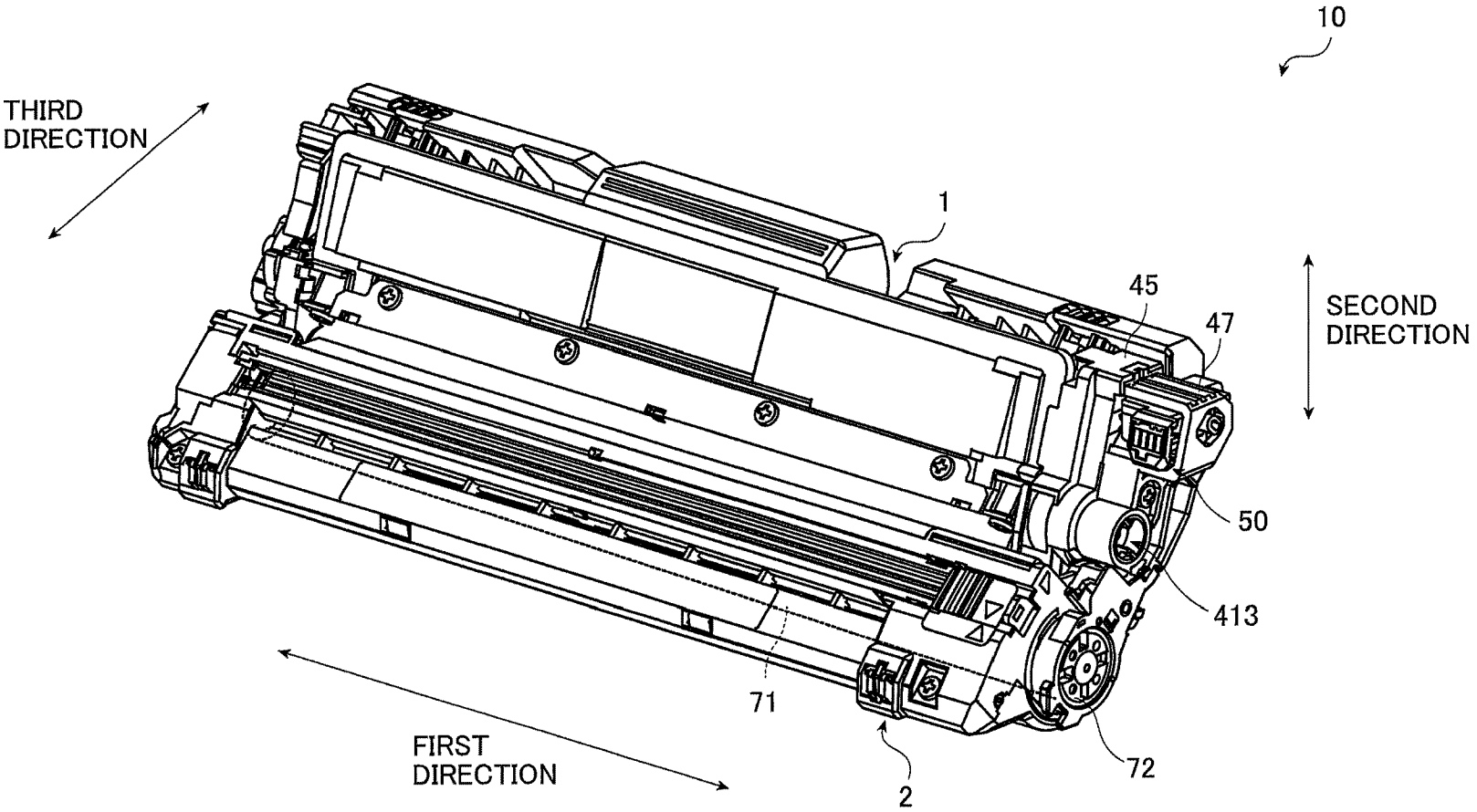
FIG. 4 is a perspective view of a process cartridge according to the embodiment.

FIG. 4 is a perspective view of the process cartridge 10. Each of the drum cartridges 2 to which the corresponding developing cartridge 1 is attached includes the photosensitive drum 71. The photosensitive drum 71 is rotatable about a rotational axis (an example of a second axis) extending in the first direction. When each of the developing cartridges 1 is attached to the corresponding drum cartridge 2, the developing roller 30 contacts the photosensitive drum 71.

The drum cartridge 2 includes a drum coupling 72 positioned at one end portion of the photosensitive drum 71 in the first direction. The drum coupling 72 is a gear configured to receive the driving force supplied from the image forming apparatus 100. The drum coupling 72 is rotatable about the rotational axis extending in the first direction together with the photosensitive drum 71.

[3.2 Attachment of Process Cartridge]

Figure 5:
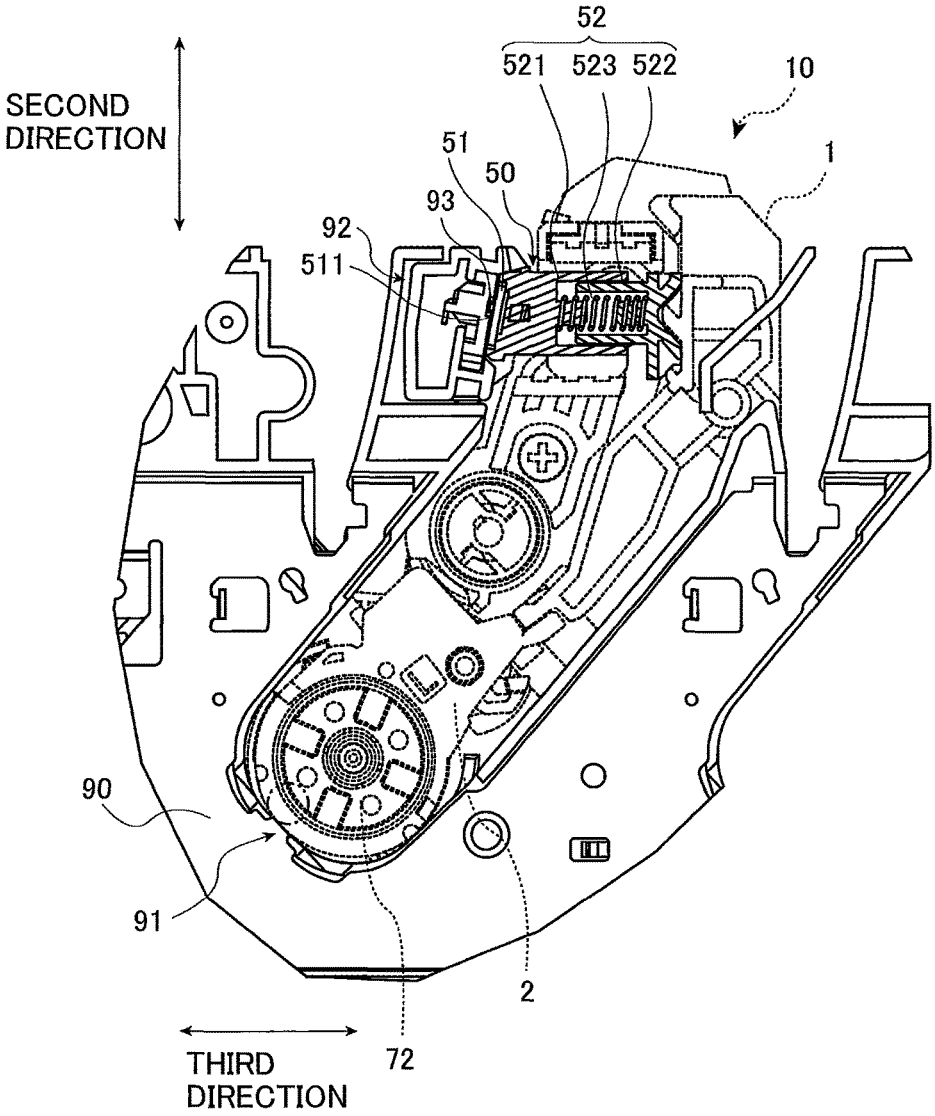
FIG. 5 is a view illustrating a state where the process cartridge according to the embodiment is attached to a cartridge holding portion of the image forming apparatus.

FIG. 5 is a view illustrating a state where the process cartridge 10 is attached to the cartridge holding portion 90 as viewed in the first direction. Note that, in FIG. 5, the process cartridge 10 is illustrated with broken lines.

The process cartridge 10 is inserted into the corresponding slot 91 of the cartridge holding portion 90 in the second direction. A guide portion 92 is positioned at a position near an insertion opening of each slot 91. The guide portion 92 supports an electrical contact 93 made of metal and contactable with the electrical contact surface 511 of the IC chip 51. When each process cartridge 10 is inserted into the corresponding slot 91, the electrical contact surface 511 of the IC chip 51 contacts the electrical contact 93.

The first holder member 521 contacts the guide portion 92 during insertion of the process cartridge 10 into the cartridge holding portion 90. The second holder member 522 is urged toward the guide portion 92 in the third direction by a frame of the cartridge holding portion 90. Thus, the first holder member 521 and the second holder member 522 move toward each other in the third direction by the guide portion 92. That is, the coil spring 523 becomes more compressed than in a state where the coil spring 523 has a natural length. When the process cartridge 10 is completely inserted into the cartridge holding portion 90 and the electrical contact surface 511 contacts the electrical contact 93, the first holder member 521 moves toward the guide portion 92 in the third direction by the biasing force of the coil spring 523 whose length is smaller than the natural length of the coil spring 523. Accordingly, the electrical contact surface 511 of the IC chip 51 contacts the electrical contact 93.

The controller 101 of the image forming apparatus 100 is configured to retrieve necessary information from the IC chip 51 through the electrical contact surface 511 in contact with the electrical contact 93. Therefore, protection of the electrical contact surface 511 of the IC chip 51 is required during, for example, transportation of the developing cartridge 1. Therefore, in case of shipment of the developing cartridge 1 alone, in case of shipment of the developing cartridge 1 attached to the drum cartridge 2, and in case of shipment of the developing cartridge 1 attached to the cartridge holding portion 90, a holder cover is attached to the holder 52 of the developing cartridge 1 to protect the IC chip 51. Hereinafter, a holder cover 60 according to a first example of the holder cover, and a holder cover 80 according to a second example of the holder cover will be described.

[4.1 Holder Cover According to First Example]

The holder cover 60 according to the first example is configured to be attached to the holder 52 of the developing cartridge 1 that is not attached to the cartridge holding portion 90.

Figure 6:
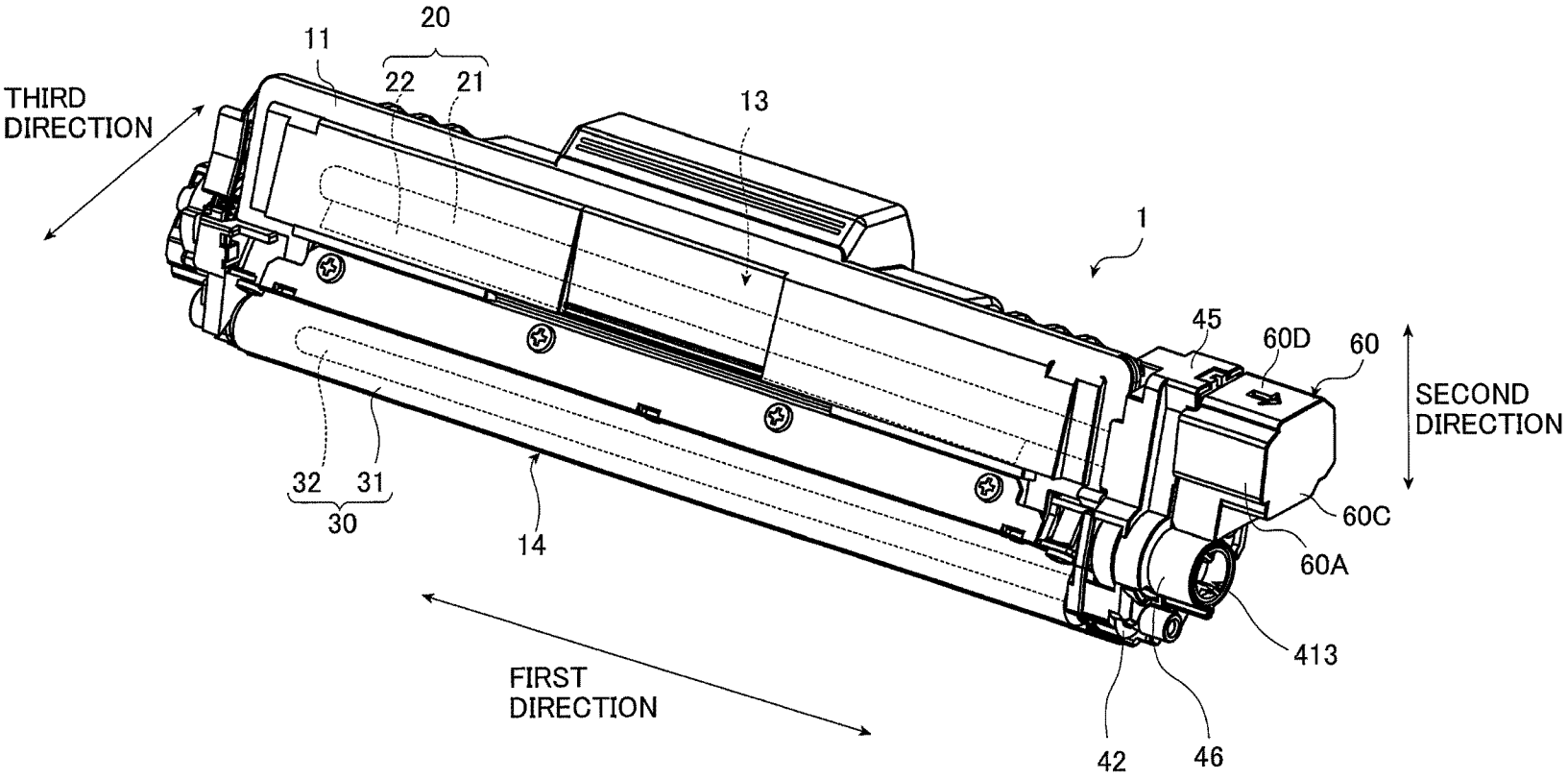
FIG. 6 is a perspective view of the developing cartridge according to the embodiment, and illustrating a state where a holder cover according to a first example is attached to a holder.
Figure 7:
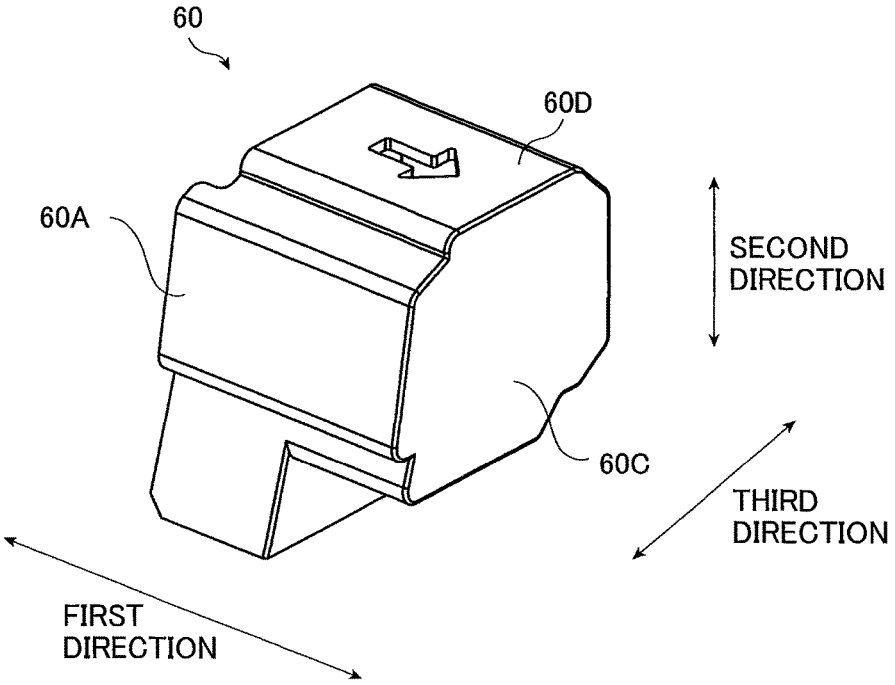
FIG. 7 is a perspective view of the holder cover according to the first example.
Figure 8:
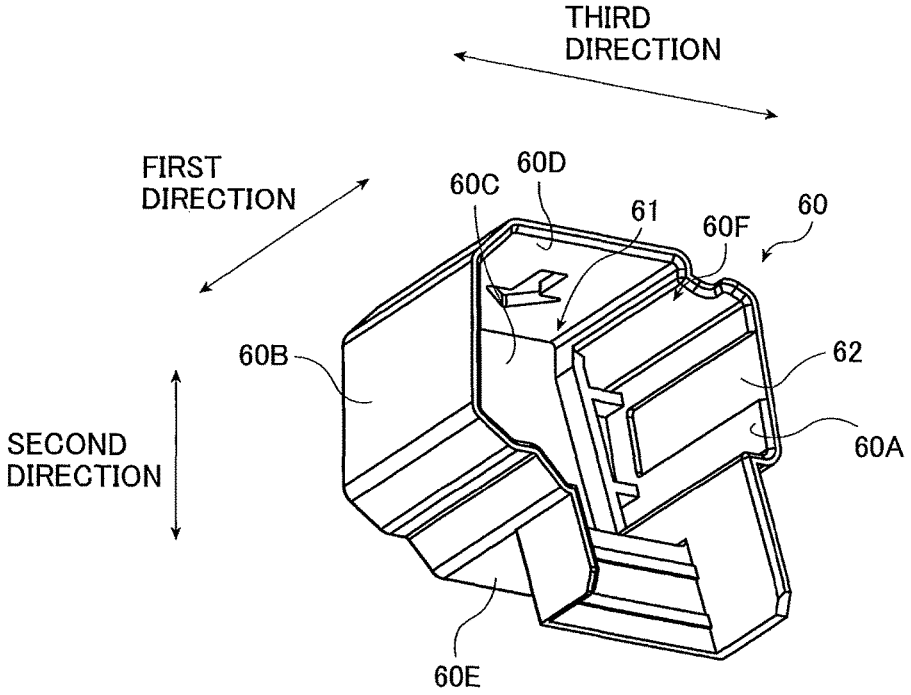
FIG. 8 is another perspective view of the holder cover according to the first example.

FIG. 6 is a perspective view of the developing cartridge 1 in which the holder cover 60 is attached to the holder 52. FIGS. 7 and 8 are perspective views of the holder cover 60 as viewed in a direction opposite to each other in the third direction.

The holder cover 60 is made of resin, for example. The holder cover 60 has an internal space 61 configured to accommodate the holder 52 holding the IC chip 51. Specifically, the holder cover 60 is attached to the outer cover 47. The outer cover 47 holds the holder 52 at a position between the inner cover 45 and the outer cover 47. The holder 52 is accommodated in the internal space 61 of the holder cover 60 through the outer cover 47.

The holder cover 60 has a generally cup shaped extending in the first direction. The holder cover 60 includes a first wall surface 60A, a second wall surface 60B, a third wall surface 60C, a fourth wall surface 60D, and a fifth wall surface 60E. The first wall surface 60A is positioned at one end portion in the third direction of the holder cover 60, and the second wall surface 60B is positioned at another end portion in the third direction of the holder cover 60. The third wall surface 60C is positioned at one end portion in the first direction of the holder cover 60. The fourth wall surface 60D is positioned at one end portion in the second direction of the holder cover 60. The fifth wall surface 60E is positioned at another end portion in the second direction of the holder cover 60. The internal space 61 of the holder cover 60 is defined by these wall surfaces 60A, 609, 60C, 60D, and 60E.

The holder cover 60 has an insertion opening 60F formed at another end portion in the first direction of the holder cover 60. The internal space 61 is in communication with the outside through the insertion opening 60F. The holder 52 is inserted into the internal space 61 of the holder cover 60 through the insertion opening 60F to be accommodated in the internal space 61.

Figure 9:
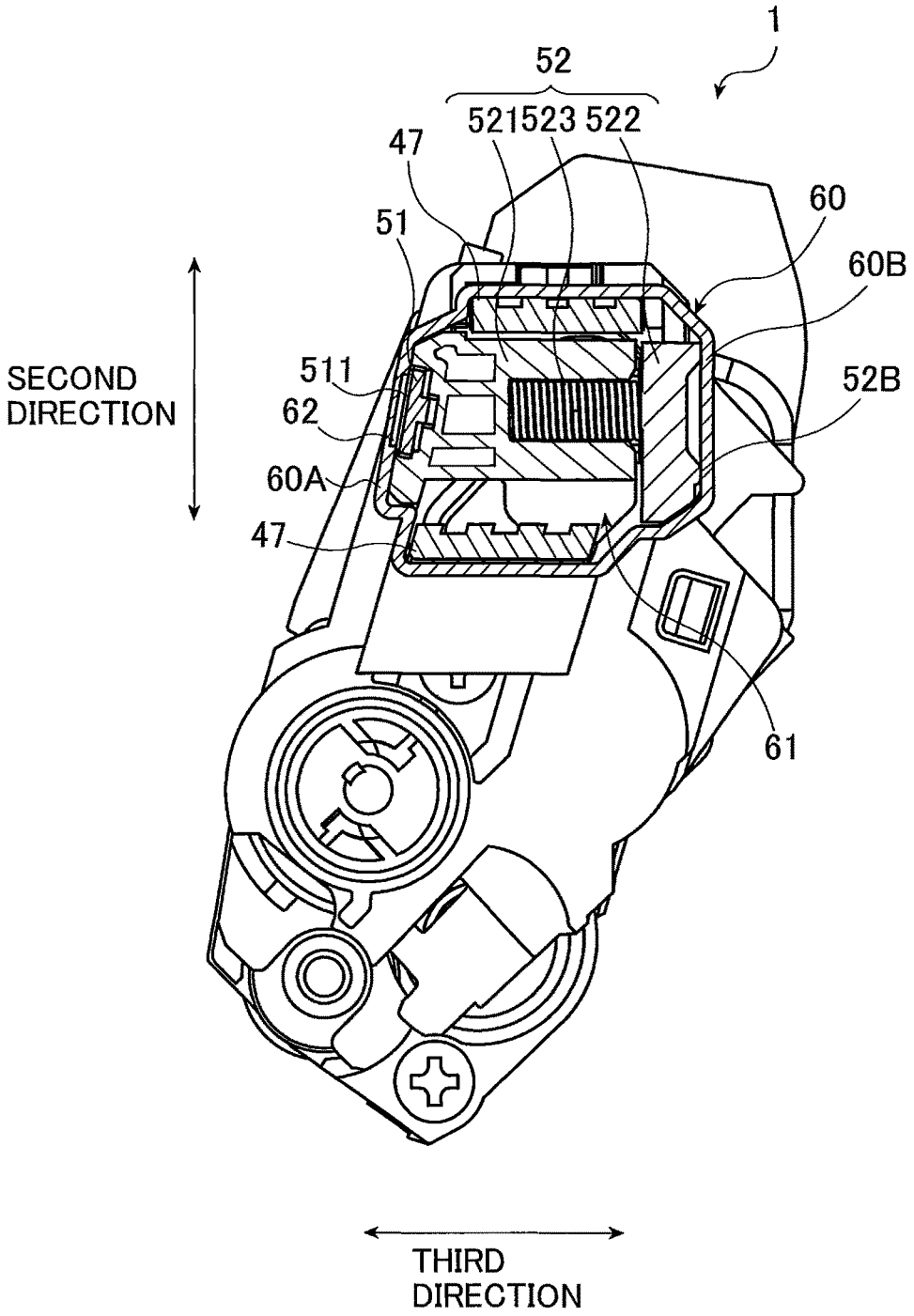
FIG. 9 is a cross-sectional view of the holder and the holder cover in the developing cartridge according to the embodiment as viewed in a first direction.

FIG. 9 is a cross-sectional view of the developing cartridge 1 in which the holder cover 60 is attached to the holder 52 as viewed in the first direction.

When the holder cover 60 is attached to the holder 52, the first wall surface 60A faces the IC chip 51 in the third direction. The electrical contact surface 511 of the IC chip 51 is covered by the first wall surface 60A. Accordingly, the electrical contact surface 511 is protected against impact from the outside. Specifically, in a state where the holder cover 60 is attached to the holder 52, the holder cover 60 covers an entirety of the electrical contact surface 511. The second wall surface 60B faces the second outer surface 52B of the holder 52 in the third direction.

The first wall surface 60A has a recessed portion 62 recessed in a direction opposite to the internal space 61 in the third direction from an inner surface of the first wall surface 60A that faces the internal space 61. The recessed portion 62 faces the electrical contact surface 511 in the third direction as a result of attachment of the holder cover 60 to the outer cover 47. With this configuration, the electrical contact surface 511 and the inner surface of the first wall surface 60A are spaced away from each other in the third direction. Thus, friction between the electrical contact surface 511 and the first wall surface 60A can be suppressed.

A distance in the third direction between the first wall surface 60A and the second wall surface 60B is smaller than the distance in the third direction between the first outer surface 52A and the second outer surface 529 in the first state of the coil spring 523. Accordingly, the holder cover 60 attached to the holder 52 holds the holder 52 while the holder cover 60 urges the first outer surface 52A toward the second outer surface 52B, and urges the second outer surface 52B toward the first outer surface 52A. In this state, the first outer surface 52A and the second outer surface 529 become closest to each other in the third direction. Specifically, an end portion of the first pawl portion 522B closer to the first outer surface 52A than an opposite end portion of the first pawl portion 522B is to the first outer surface 52A is in contact with the edge of the first opening 521A closer to the first outer surface 52A than the opposite edge of the first opening 521A is to the first outer surface 52A in the third direction. Further, an end portion of the second pawl portion 522C closer to the first outer surface 52A than an opposite end portion of the second pawl portion 522C is to the first outer surface 52A is in contact with the edge of the second opening closer to the first outer surface 52A than the opposite edge of the second opening is to the first outer surface 52A in the third direction. Since the holder cover 60 is attached to the outer cover 47 while the first outer surface 52A and the second outer surface 52B are closest to each other in the third direction, the first holder member 521 and the second holder member 522 do not move in the third direction relative to the holder cover 60. Note that, in a state where the holder cover 60 is attached to the holder 52, the coil spring 523 is in the second state. On the other hand, in a state where the holder cover 60 is not attached to the holder 52, the coil spring 523 is in the first state.

In this way, expansion and contraction of the coil spring 523 can be restrained by attaching the holder cover 60 to the holder 52. As a result, a breakdown of the electrical contact surface 511 due to contact of the electrical contact surface 511 with an external object due to expansion and contraction of the coil spring 523 during transportation of the developing cartridge 1 can be suppressed.

Further, in a state where the holder cover 60 is attached to the holder 52, the holder cover 60 covers the entirety of the electrical contact surface 511. With this configuration, the electrical contact surface 511 can be more reliably protected by the holder cover 60.

Figure 10:
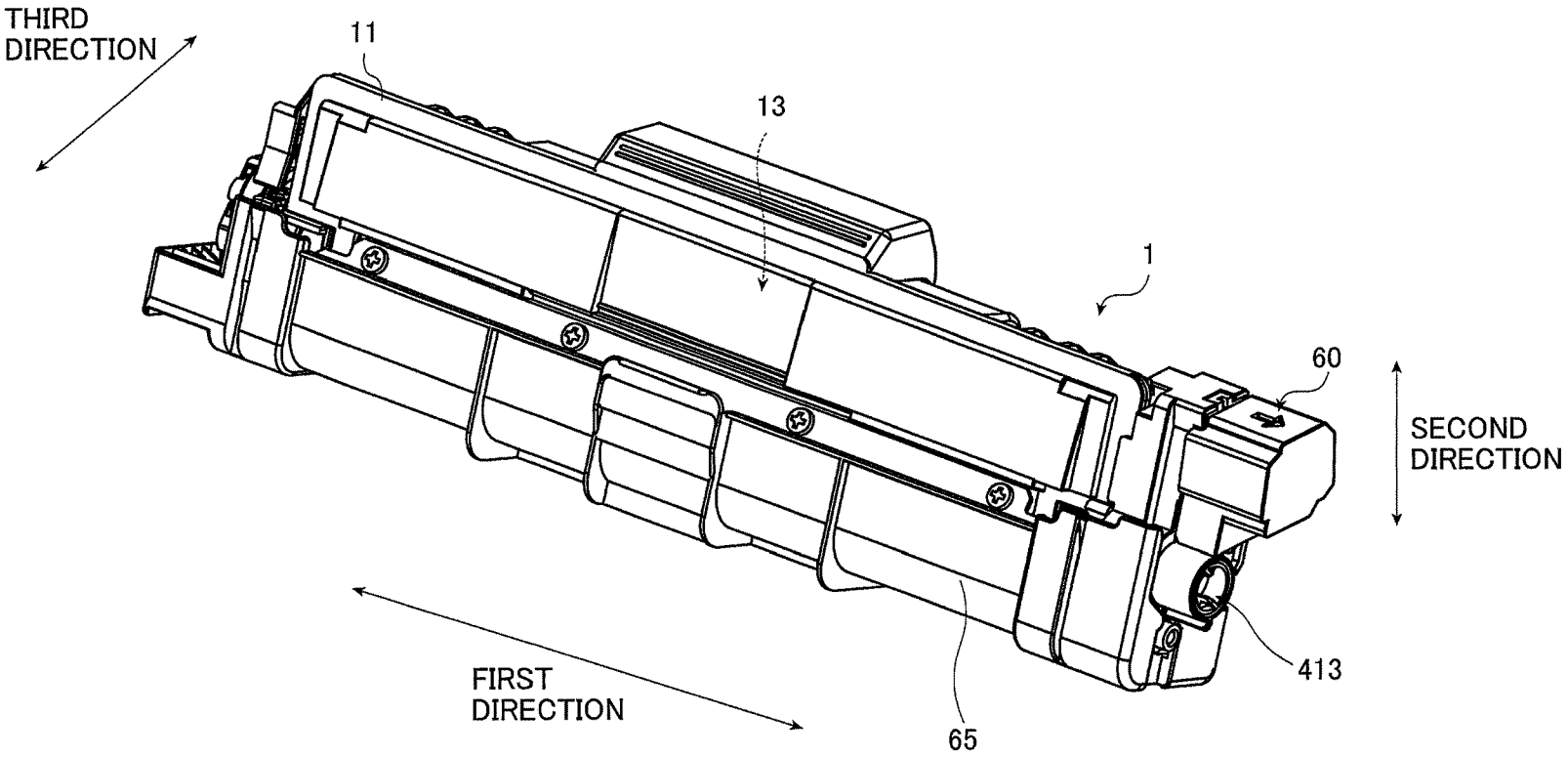
FIG. 10 is a perspective view of the developing cartridge according to the embodiment, and illustrating a state where a roller cover is attached to a developing roller.

Incidentally, the developing cartridge 1 may include a cover for covering the developing roller 30. FIG. 10 is a perspective view of the developing cartridge 1 in which a roller cover 65 is attached to the developing roller 30. The roller cover 65 is attached to the casing 11 of the developing cartridge 1 to cover the developing roller 30 and a portion of the gear portion 40. This configuration can restrain the developing roller 30 from being damaged.

[4.2 Holder Cover According to Second Example]

The holder cover 80 according to the second example is configured to be used for the process cartridge 10.

Figure 11:
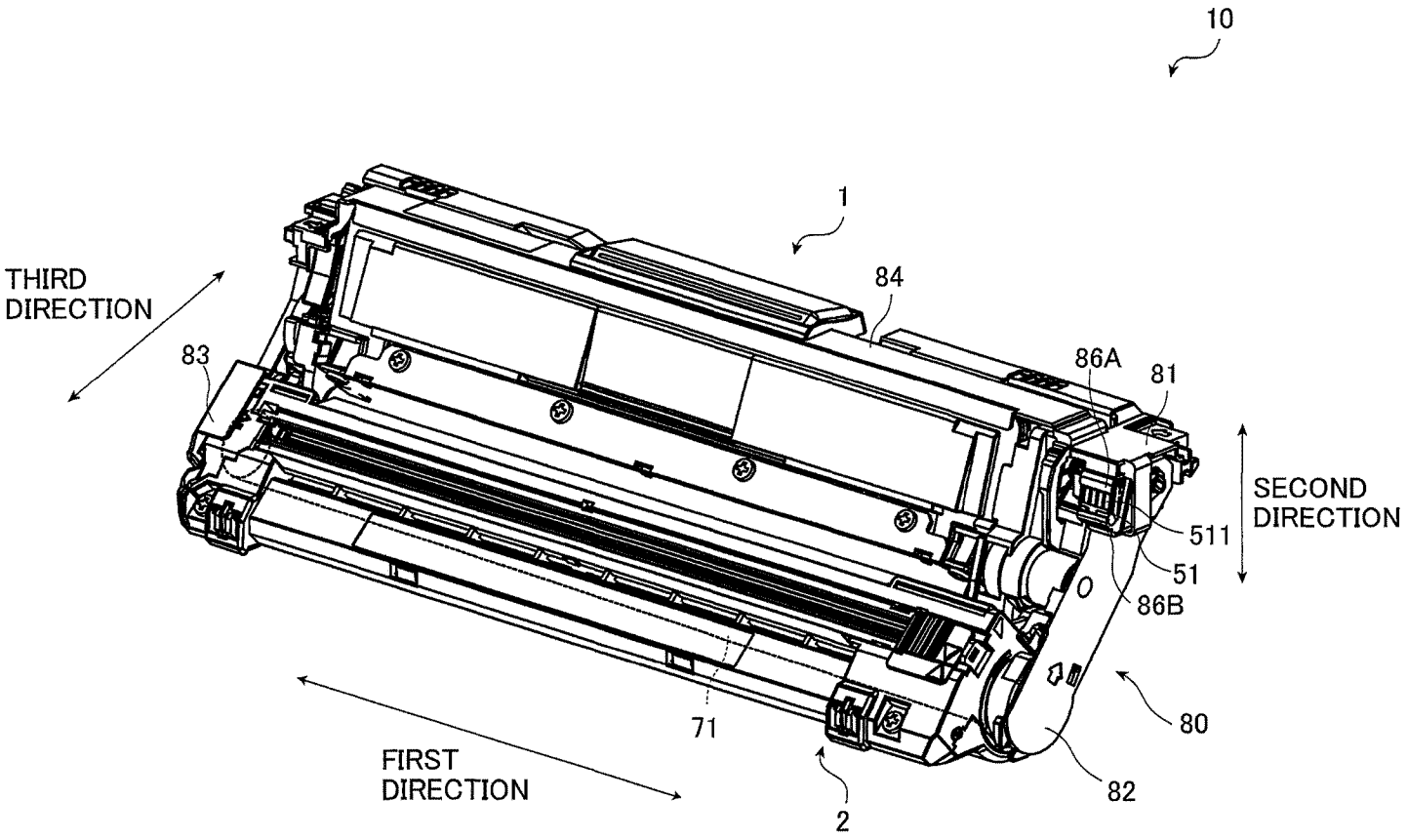
FIG. 11 is a perspective view of the process cartridge according to the embodiment, and illustrating a state where a holder cover according to a second example is attached to the holder.
Figure 12:
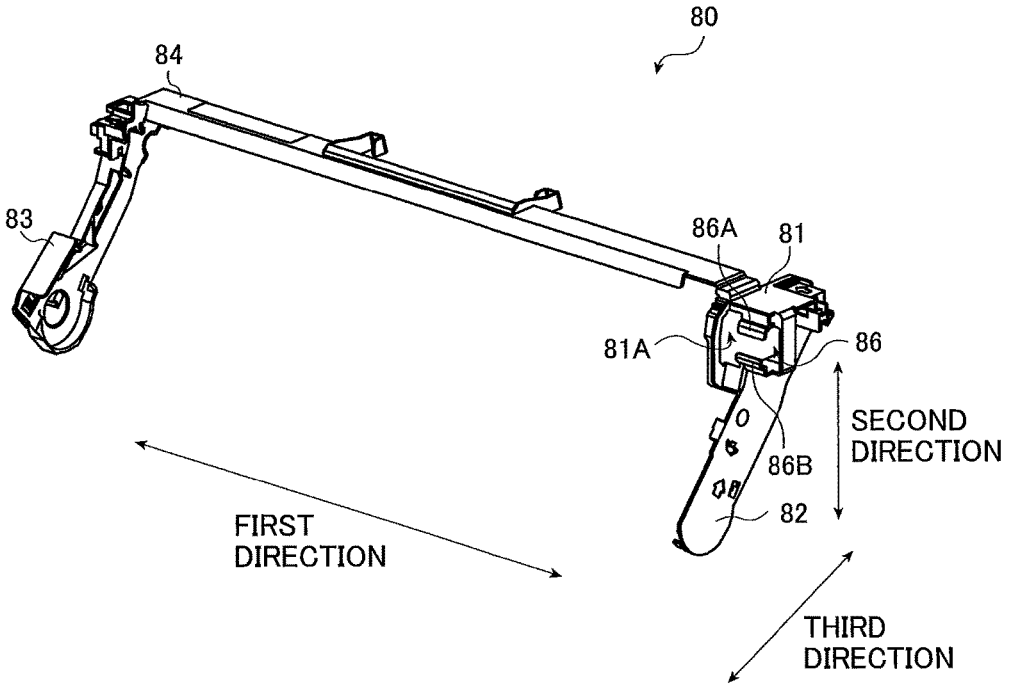
FIG. 12 is a perspective view of the holder cover according to the second example.

FIG. 11 is a perspective view of the process cartridge 10 in which the holder cover 80 is attached to the holder 52. FIG. 12 is a perspective view of the holder cover 80.

The holder cover 80 is made of resin, for example. The holder cover 80 includes a holder retaining portion 81, a coupling cover portion 82, an electrode cover portion 83, and an arm 84.

The arm 84 extends in the first direction. The coupling cover portion 82 extends in the second direction. The coupling cover portion 82 is positioned at one end portion in the first direction of the arm 84. The electrode cover portion 83 extends in the second direction. The electrode cover portion 83 is positioned at another end portion in the first direction of the arm 84. That is, the coupling cover portion 82 and the electrode cover portion 83 oppose each other in the first direction.

The holder retaining portion 81 is positioned at the one end portion in the first direction of the arm 84, and at one end portion in the second direction of the coupling cover portion 82. That is, the holder retaining portion 81 is positioned at a connecting portion of the arm 84 and the coupling cover portion 82. The holder retaining portion 81 is attached to the holder 52. More specifically, similar to the holder cover 60, the holder retaining portion 81 is attached to the outer cover 47 (see FIG. 2) holding the holder 52 at a position between the inner cover 45 and the outer cover 47. The holder retaining portion 81 is configured to hold the holder 52 at both sides thereof in the second direction.

The holder retaining portion 81 has an insertion opening 81A open toward the electrode cover portion 83 in the first direction. The holder 52 is inserted into the holder retaining portion 81 through the insertion opening 81A. Accordingly, the holder retaining portion 81 is attached to the holder 52.

The holder retaining portion 81 has one end in the third direction formed with an opening 86. The IC chip 51 is exposed to the outside in the third direction through the opening 86 in a state where the holder retaining portion 81 is attached to the outer cover 47.

The holder retaining portion 81 has a chip protecting portion 86A and a chip protecting portion 86B. Each of the chip protecting portion 86A and the chip protecting portion 86B is configured to cover a part of the opening 86 in the third direction. The chip protecting portion 86A and the chip protecting portion 86B are positioned at edges of the opening 86 that faces to each other in the second direction, respectively. The chip protecting portion 86A extends in the second direction toward the chip protecting portion 86B, and the chip protecting portion 86B extends in the second direction toward the chip protecting portion 86A. The chip protecting portion 86A and the chip protecting portion 86B are spaced away from each other in the second direction. A space defined between the chip protecting portion 86A and the chip protecting portion 86B in the second direction faces the electrical contact surface 511 in the third direction as a result of attachment of the holder retaining portion 81 to the holder 52.

The holder cover 80 attached to the holder 52 holds the holder 52 while the holder cover 80 urges the first outer surface 52A toward the second outer surface 52B, and urges the second outer surface 52B toward the first outer surface 52A. In this state, the first outer surface 52A and the second outer surface 52B are positioned closest to each other in the third direction. Thus, the first holder member 521 and the second holder member 522 are immovable in the third direction relative to the holder cover 80. That is, expansion and contraction of the coil spring 523 is restrained. As a result, a breakdown of the electrical contact surface 511 due to contact of the electrical contact surface 511 with an external object due to expansion and contraction of the coil spring 523 during transportation of the developing cartridge 1 can be restrained.

When the holder retaining portion 81 is attached to the holder 52, the coupling cover portion 82 is attached to the coupling hole 413 of the coupling 41, and the drum coupling 72 in the first direction. At this time, the electrode cover portion 83 covers a developing electrode (not illustrated).

In a state where the holder cover 80 is attached to the holder 52, the process cartridge 10 can be attached to the cartridge holding portion 90.

Figure 13:
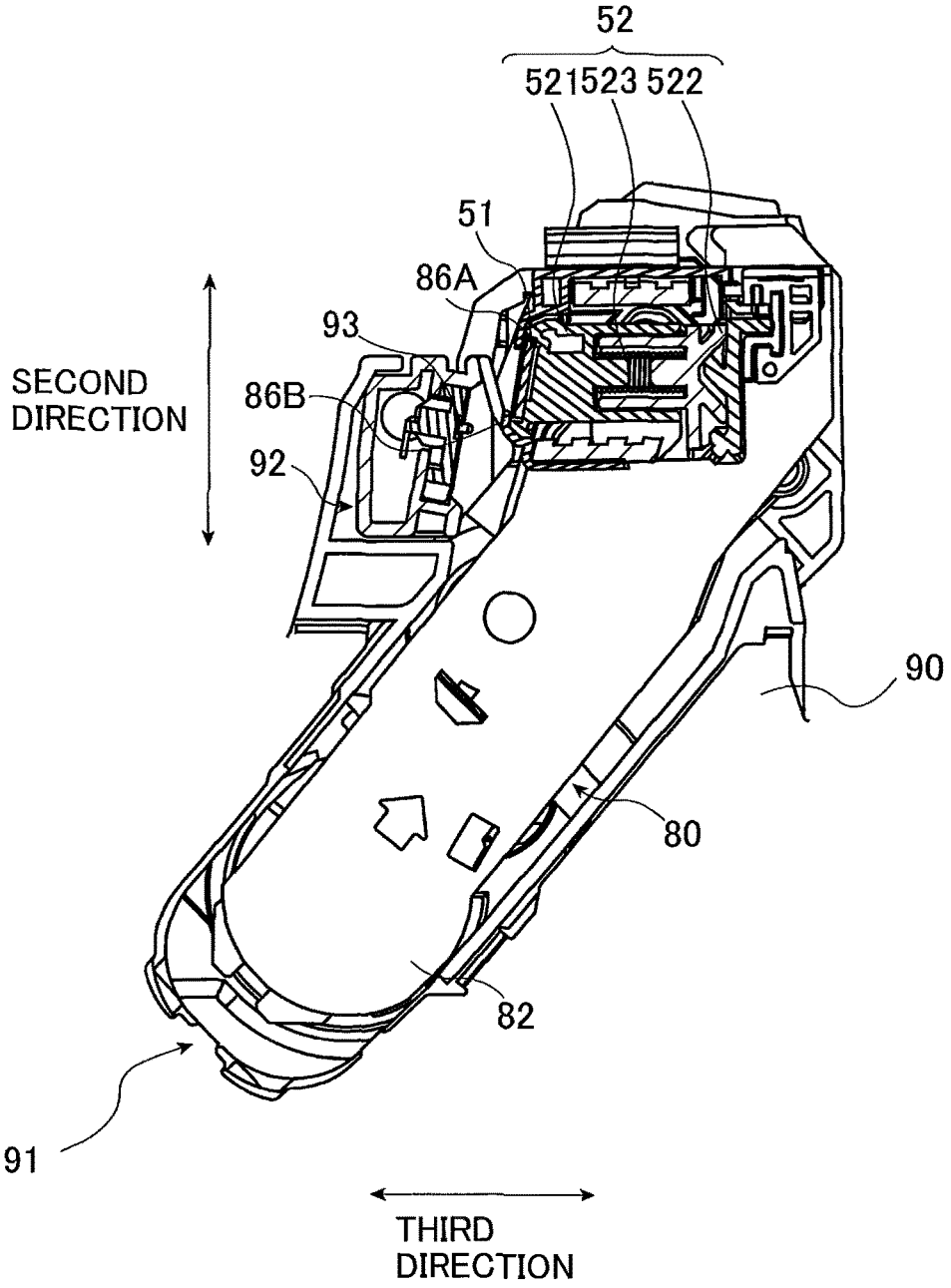
FIG. 13 is a view illustrating an insertion process of the process cartridge in which the holder cover according to the second example is attached to the holder into the cartridge holding portion.
Figure 14:
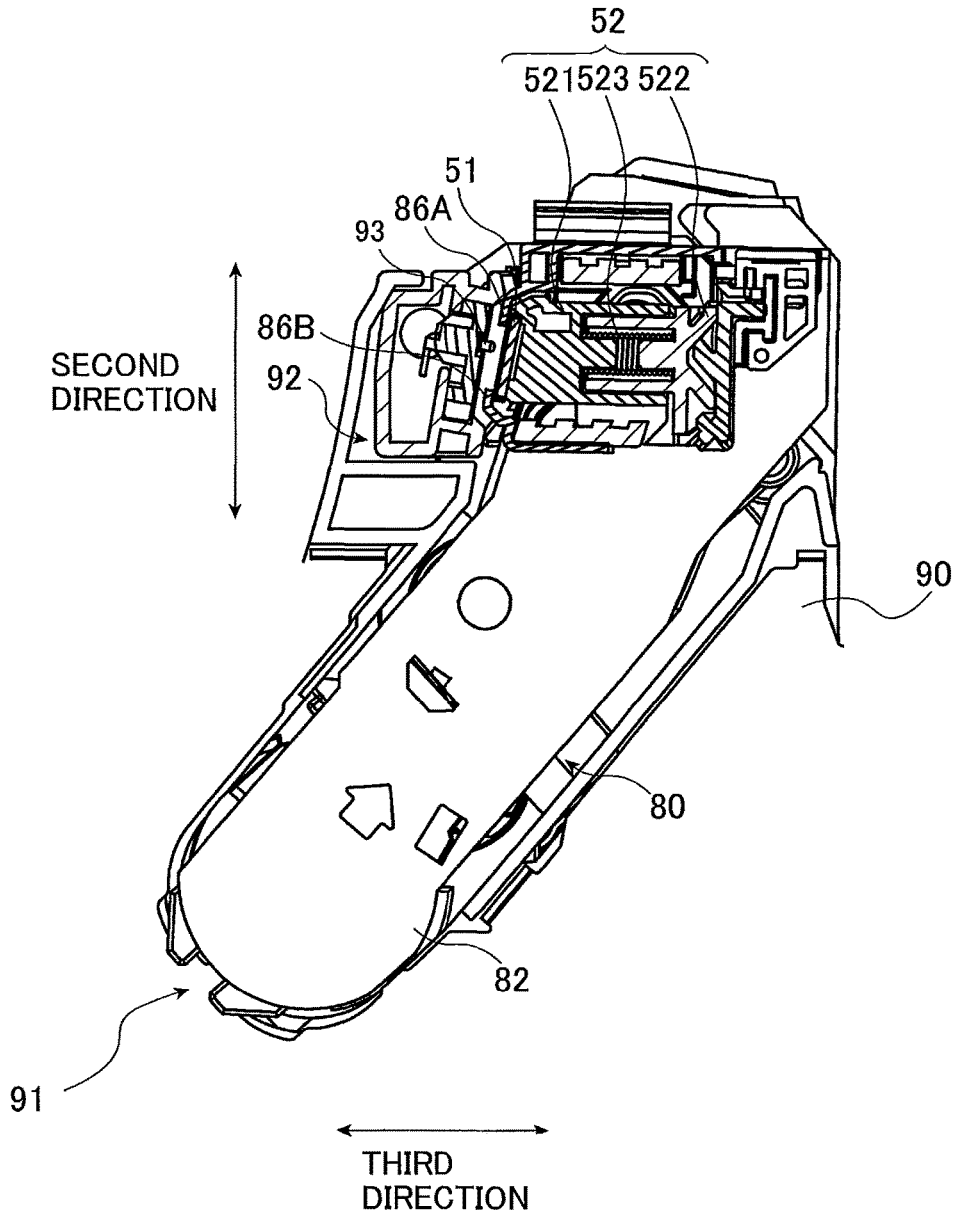
FIG. 14 is a view illustrating a state where the process cartridge in which the holder cover according to the second example is attached to the holder has been completely inserted into the cartridge holding portion.

FIGS. 13 and 14 are views illustrating states in which the process cartridge 10 in which the holder cover 80 is attached to the holder 52 is attached to the cartridge holding portion 90. FIG. 13 illustrates an insertion process of the process cartridge 10 into the cartridge holding portion 90 as viewed in the first direction. FIG. 14 illustrates a state where the process cartridge 10 is completely inserted into the cartridge holding portion 90 as viewed in the first direction.

The process cartridge 10, in which the holder cover 80 is attached to the holder 52, is inserted into the slot 91 of the cartridge holding portion 90 in the second direction. The guide portion 92 is positioned at the position adjacent to the insertion opening of the slot 91. The guide portion 92 supports the electrical contact 93. The electrical contact surface 511 of the IC chip 51 of the developing cartridge 1 contacts the electrical contact 93 as a result of insertion of the process cartridge 10 into the slot 91.

In a case where the holder cover 80 is not attached to the holder 52, the first holder member 521 and the second holder member 522 approach each other by the guide portion 92 in the third direction during insertion process of the process cartridge 10. On the other hand, in a case where the holder cover 80 is attached to the holder 52, the holder cover 80 holds the holder 52 while the first outer surface 52A and the second outer surface 52B are closest to each other. Therefore, as illustrated in FIG. 13, the process cartridge 10 can be inserted into the slot 91 without any contact of the holder cover 80 with the guide portion 92.

The electrical contact surface 511 moves to a position facing the electrical contact 93 in the third direction upon completion of attachment of the process cartridge 10 to the cartridge holding portion 90. The holder cover 80 holds the holder 52 while restraining expansion and contraction of the coil spring 523. Therefore, the first holder member 521 does not move in the third direction toward the guide portion 92 even after the process cartridge 10 has been completely inserted into the cartridge holding portion 90. Accordingly, the electrical contact surface 511 does not contact the electrical contact 93.

Further, the space defined between the chip protecting portion 86A and the chip protecting portion 86B in the second direction faces the electrical contact surface 511 in the third direction. Therefore, the holder cover 80 is not positioned between the electrical contact surface 511 and the electrical contact 93 in the third direction. Hence, the electrical contact 93 does not contact the holder cover 80 even after the attachment of the process cartridge 10 to the cartridge holding portion 90.

In this way, the process cartridge 10 can be attached to the cartridge holding portion 90 even after the attachment of the holder cover 80 to the holder 52. This configuration can prevent friction between the electrical contact surface 511 and the electrical contact 93. Further, contact between the electrical contact 93 and the holder cover 80 can be suppressed, whereby the electrical contact 93 can be protected.

[5. Modifications]

While the description has been made in detail with reference to the embodiment thereof, it would be apparent to those skilled in the art that many modifications and variations may be made thereto without departing from the spirit of the disclosure. In the following description, various modifications will be described while indicating differences between each modification and the above-described embodiment.

In the first example of the holder cover, the holder cover 60 is attached to the holder 52 of the developing cartridge 1 that is not attached to the drum cartridge 2. However, the holder cover 60 may be attached to the holder 52 of the developing cartridge 1 that has been attached to the drum cartridge 2.

Further, in the above-described embodiment, the holder cover holds the holder 52 while the first holder member 521 and the second holder member 522 are positioned closest to each other. However, when the holder cover is attached to the holder 52, the coil spring 523 may have any length as long as the length of the coil spring 523 is smaller than the natural length of the coil spring 523.

Further, in the above-described embodiment, the IC chip 51 having the electrical contact surface 511 is fixed at the outer surface of the holder 52. However, only the electrical contact surface 511 for contacting the electrical contact 93 may be fixed to the outer surface of the holder 52, and a portion of the IC chip 51 other than the electrical contact surface 511 may be positioned in the developing cartridge 1 at a position different from the position of the electrical contact surface 511.

Further, in the above-described embodiment, the coil spring 523 is used as the resilient member. However, a leaf spring, a torsion spring and the like may be used instead of the coil spring 523.

Further, each part and component constituting the image forming apparatus may have a shape or profile different from that in the above-described embodiment. Further, various elements appearing in the above-described embodiment and the modifications may be suitably combined together avoiding conflicting combination.

What is claimed is:

1. A developing cartridge comprising:

a casing configured to accommodate toner therein;

a developing roller rotatable about a first axis extending in a first direction, the developing roller being positioned at one end portion of the casing in a second direction;

a storage medium having an electrical contact surface;

a holder positioned at one end of the casing in the first direction, the holder holding the electrical contact surface, the holder having:

a first outer surface positioned at one end portion of the holder in a third direction crossing the electrical contact surface, the first outer surface holding the electrical contact surface;

a second outer surface positioned at another end portion of the holder in the third direction, the second outer surface being spaced away from the first outer surface in the third direction; and a resilient member positioned between the first outer surface and the second outer surface, the resilient member being configured to expand and contract in the third direction, the resilient member being connected to the first outer surface and to the second outer surface, a distance between the first outer surface and the second outer surface in the third direction being configured to change by the expansion and contraction of the resilient member; and a holder cover configured to be attached to the holder to cover at least a portion of the holder, the holder cover being configured to urge the first outer surface toward the second outer surface and to urge the second outer surface toward the first outer surface in a state where the holder cover is attached to the holder, the resilient member having a first length in the third direction in a state where the holder cover is detached from the holder, the resilient member having a second length in the third direction smaller than the first length in a state where the holder cover is attached to the holder.

2. The developing cartridge according to claim 1, wherein the holder cover covers an entirety of the electrical contact surface in a state where the holder cover is attached to the holder.

3. The developing cartridge according to claim 2, wherein the holder cover has an inner surface, and wherein, in a state where the holder cover is attached to the holder, the electrical contact surface faces the inner surface in the third direction and is spaced away from the inner surface in the third direction.

4. A process cartridge comprising:

a developing cartridge comprising:

a casing configured to accommodate toner therein;

a developing roller rotatable about a first axis extending in a first direction, the developing roller being positioned at one end portion of the casing in a second direction;

a storage medium having an electrical contact surface;

a holder positioned at one end of the casing in the first direction, the holder holding the electric contact surface, the holder having:

a first outer surface positioned at one end portion of the holder in a third direction crossing the electrical contact surface, the first outer surface holding the electrical contact surface;

a second outer surface positioned at another end portion of the holder in the third direction, the second outer surface being spaced away from the first outer surface in the third direction; and a resilient member positioned between the first outer surface and the second outer surface, the resilient member being configured to expand and contract in the third direction, the resilient member being connected to the first outer surface and to the second outer surface, a distance between the first outer surface and the second outer surface in the third direction being configured to change by the expansion and contraction of the resilient member; and a holder cover configured to be attached to the holder to cover at least a portion of the holder, the holder cover being configured to urge the first outer surface toward the second outer surface and to urge the second outer surface toward the first outer surface in a state where the holder cover is attached to the holder, the resilient member having a first length in the third direction in a state where the holder cover is detached from the holder, the resilient member having a second length in the third direction smaller than the first length in a state where the holder cover is attached to the holder; and a drum cartridge to which the developing cartridge is attachable, the drum cartridge comprising:

a photosensitive drum rotatable about a second axis extending in the first direction; and a drum coupling positioned at one end portion of the photosensitive drum in the first direction, the holder cover being configured to cover the drum coupling of the drum cartridge in a state where the holder cover is attached to the holder of the developing cartridge that has been attached to the drum cartridge.

5. The process cartridge according to claim 4, wherein the developing cartridge further comprises a developing coupling positioned at one side of the developing roller in the first direction, and wherein the holder cover is configured to cover the developing coupling in a state where the holder cover is attached to the holder of the developing cartridge that has been attached to the drum cartridge.

6. An image forming apparatus to which the developing cartridge according to claim 1 is attachable, the image forming apparatus comprising:

an electrical contact configured to be in contact with the electrical contact surface in a state where the developing cartridge in which the holder cover is not attached to the holder is attached to the image forming apparatus, the electrical contact being configured to be spaced away from the electrical contact surface in the third direction in a state where the developing cartridge in which the holder cover is attached to the holder is attached to the image forming apparatus.

7. An image forming apparatus comprising:

a developing cartridge comprising:

a casing configured to accommodate toner therein;

a developing roller rotatable about a first axis extending in a first direction, the developing roller being positioned at one end portion of the casing in a second direction;

a storage medium having an electrical contact surface;

a holder positioned at one end of the casing in the first direction, the holder holding the electric contact surface, the holder having:

a first outer surface positioned at one end portion of the holder in a third direction crossing the electrical contact surface, the first outer surface holding the electrical contact surface;

a second outer surface positioned at another end portion of the holder in the third direction, the second outer surface being spaced away from the first outer surface in the third direction; and a resilient member positioned between the first outer surface and the second outer surface, the resilient member being configured to expand and contract in the third direction, the resilient member being connected to the first outer surface and to the second outer surface, a distance between the first outer surface and the second outer surface in the third direction being configured to change by the expansion and contraction of the resilient member; and a holder cover configured to be attached to the holder to cover at least a portion of the holder, the holder cover being configured to urge the first outer surface toward the second outer surface and to urge the second outer surface toward the first outer surface in a state where the holder cover is attached to the holder, the resilient member having a first length in the third direction in a state where the holder cover is detached from the holder, the resilient member having a second length in the third direction smaller than the first length in a state where the holder cover is attached to the holder;

a cartridge holding portion to which the developing cartridge is attachable; and an electrical contact configured to be in contact with the electrical contact surface in a state where the developing cartridge in which the holder cover is not attached to the holder is attached to the cartridge holding portion, the electrical contact being configured to be spaced away from the electrical contact surface in the third direction in a state where the developing cartridge in which the holder cover is attached to the holder is attached to the cartridge holding portion.

* * * * *